US008567137B2

(12) United States Patent
Sullivan

(10) Patent No.: US 8,567,137 B2
(45) Date of Patent: Oct. 29, 2013

(54) PET DOOR PANEL STORM WINDOW

(75) Inventor: Thomas D. Sullivan, Hamilton, NJ (US)

(73) Assignee: Accession, Inc., Hamilton, NJ (US)

( * ) Notice: Subject to any disclaimer, the term of this patent is extended or adjusted under 35 U.S.C. 154(b) by 673 days.

(21) Appl. No.: 12/655,674

(22) Filed: Jan. 5, 2010

(65) Prior Publication Data

US 2010/0175336 A1 Jul. 15, 2010

Related U.S. Application Data

(60) Provisional application No. 61/204,872, filed on Jan. 12, 2009.

(51) Int. Cl.
*E05F 11/52* (2006.01)
*E06B 3/26* (2006.01)
*E04B 1/04* (2006.01)

(52) U.S. Cl.
USPC ..... 52/207; 52/202; 49/168

(58) Field of Classification Search
USPC ..... 52/202, 203, 204.5, 207, 213; 119/484; 49/168–171, 490.1
See application file for complete search history.

(56) References Cited

U.S. PATENT DOCUMENTS

| | | | | |
|---|---|---|---|---|
| 2,595,975 | A | 5/1952 | Nothdurft | 160/91 |
| 3,367,389 | A * | 2/1968 | Kruse | 160/91 |
| 3,420,001 | A | 1/1969 | Raymon | 49/407 |
| 3,471,189 | A | 10/1969 | Ness | 292/262 |
| 3,654,733 | A | 4/1972 | Blackwell | 49/168 |
| 3,811,224 | A | 5/1974 | Garrison | 49/168 |
| 3,816,967 | A | 6/1974 | Littrell | 49/449 |
| 3,878,645 | A | 4/1975 | Porter | 49/169 |
| 4,047,331 | A | 9/1977 | Davlantes | 49/171 |
| 4,322,913 | A | 4/1982 | Himmer | 49/168 |
| 4,385,470 | A | 5/1983 | Bryson et al. | 49/63 |
| 4,408,416 | A | 10/1983 | Davlantes | 49/168 |
| 4,776,133 | A | 10/1988 | Green | 49/394 |
| 4,927,198 | A | 5/1990 | Fennell et al. | 292/306 |
| 5,123,211 | A * | 6/1992 | Schlicht et al. | 52/202 |
| 5,185,954 | A | 2/1993 | Waddle, Sr. | 49/168 |
| 5,269,097 | A | 12/1993 | Davlantes | 49/169 |
| 5,287,654 | A | 2/1994 | Davlantes | 49/169 |
| 5,551,188 | A | 9/1996 | Davlantes | 49/169 |
| 5,603,190 | A | 2/1997 | Sanford | 52/202 |
| 5,906,070 | A | 5/1999 | Boerhave | 49/207 |
| 5,946,855 | A | 9/1999 | Miconi | 49/163 |
| 5,946,856 | A * | 9/1999 | Davlantes | 49/168 |
| 6,272,793 | B1 | 8/2001 | Davlantes | 49/168 |
| 6,591,553 | B1 * | 7/2003 | Vaughn | 49/466 |
| 6,691,483 | B2 | 2/2004 | Lethers | 52/455 |
| 7,063,123 | B2 | 6/2006 | Lethers | 160/180 |
| 7,207,141 | B2 | 4/2007 | Sullivan | 49/169 |
| 7,363,956 | B2 | 4/2008 | Lethers | 160/180 |
| 7,484,286 | B2 * | 2/2009 | Fowler | 29/401.1 |

(Continued)

*Primary Examiner* — Joshua J Michener
*Assistant Examiner* — Elizabeth A Plummer
(74) *Attorney, Agent, or Firm* — Watov & Kipnes, P.C.; Kenneth Watov

(57) ABSTRACT

A pet door panel or module is configured to include a pocket window opening having an open side portion to permit a ventilation screen to be slid into the pocket on centrally located tracks to provide ventilation means, and to further permit dual panel storm window means to be slid into the pocket via tracks on either side of the centrally located track to enclose the screen between the window panes to prevent air from flowing through the window opening to protect from foul weather and insulate from cold outside temperatures.

8 Claims, 23 Drawing Sheets

(56) References Cited

U.S. PATENT DOCUMENTS

| | | | | |
|---|---|---|---|---|
| 7,603,819 | B2 * | 10/2009 | Heltai | 52/202 |
| 7,913,454 | B2 * | 3/2011 | Sullivan | 49/169 |
| 8,186,123 | B2 * | 5/2012 | Klaffke et al. | 52/656.4 |
| 2007/0107856 | A1 * | 5/2007 | Cordova | 160/183 |
| 2008/0028701 | A1 * | 2/2008 | White | 52/207 |
| 2008/0302030 | A1 * | 12/2008 | Stancel et al. | 52/173.3 |
| 2009/0183433 | A1 * | 7/2009 | Cheung et al. | 49/169 |
| 2011/0016807 | A1 * | 1/2011 | Amato | 52/204.5 |

* cited by examiner

PET DOOR PANEL STORM WINDOW

RELATED PATENT, AND APPLICATION

The present invention is related to U.S. Pat. No. 7,207,141, entitled "Sliding Door Insert for Portable Pet Portal," issued on Apr. 24, 2007. The present invention also takes priority from Provisional Application No. 61/204,872, filed on Jan. 12, 2009. The teachings of the related patent, and co-pending Provisional Application, are incorporated herein by reference to the extent that they do not conflict herewith.

FIELD OF THE INVENTION

The present invention relates generally to building access, and more particularly to a storm window and window screen for a window module.

BACKGROUND OF THE INVENTION

When a pet door panel is inserted in a sliding patio door the ability to utilize the screen door feature of the sliding patio door to ventilate the room to outside air is restricted since doing so would make the pet portal unusable as the screen door would block ingress and egress from and to the outside of the room. For example, the pet door panel, as described in U.S. Pat. No. 7,207,141, consists of three modules that are assembled to form the pet door panel for a sliding patio door. The bottom module contains the pet portal while the center and top modules are essentially solid filler pieces.

The current state of the art pet door panels for sliding patio doors do not have any ventilation feature and must be removed from the sliding patio door in order to close the screen to ventilate the room while keeping insects out or sliding the screen door closed over the pet door panel preventing ingress and egress of a pet through the pet portal. An aftermarket filler strip is available that may permit the screen door to be closed to the edge of the pet door panel leaving the portal free for pet use. However, in this configuration the screen door cannot be locked to prevent passage of a person.

Accordingly, there is a need for a pet door panel adapted to permit ventilation to the outside air directly through the sliding door insert for portable pet portal while providing a double pane clear polymer storm window for protection in foul weather and/or insulation in cold weather. There is a further need for a pet door panel wherein the center and top modules have openings housing a ventilation screen and storm window. In this manner, the storm window can be removed allowing outside air to infiltrate into the interior of the room containing the patio door and pet door panel without the need to remove the pet door panel and close the sliding patio door screen. There is a further need for a pet door panel whereby the screens are an integral part of the pet door and as such permit ventilation with the pet door panel installed and the sliding patio door locked preventing the unwanted passage of a person.

SUMMARY OF THE INVENTION

The present invention relates generally to a pet door panel adapted to permit ventilation to the outside air directly through the sliding door insert for portable pet portal while providing a single or double pane clear polymer storm window for protection in foul weather and/or insulation in cold weather. The pet door panel includes center and top modules having openings housing a ventilation screen and storm window. In this manner, the storm window can be removed allowing outside air to infiltrate into the interior of the room containing the patio door and pet door panel without the need to remove the pet door panel and close the sliding patio door screen. The pet door panel includes screens, which permit ventilation while the pet door panel is installed and the sliding patio door is locked, thereby preventing the unwanted passage of a person.

The present invention is operatively associated with a modular component pet access door designed for use in sliding glass patio doors. The modular construction permits the apparatus to be packaged and stored in a portable compact container when in a disassembled state. The compact size of the disassembled unit minimizes storage space requirements while facilitating transportation opportunities by the retailer and consumer. Modular construction and the design of components permit the invention to be changed in the field to accommodate a variety of styles and sizes of sliding glass patio doors. The universal nature of the modular construction and component system enhances the portability of the apparatus and permits the pet access door to be adjusted in the field to accommodate a growing pet or a new pet.

The present invention requires no tools to install nor does it require modification to any component of an existing sliding glass patio door. When assembled the modules and components create a sliding glass patio door pet access door panel.

The present invention is designed for simple assembly in the field by the consumer. Once assembled the panel may be installed and removed as one piece. The leading edge of the panel is designed to fit into the moveable sliding door side of the patio doorframe to create a secure fit and effective weather seal.

BRIEF DESCRIPTION OF THE DRAWINGS

The following drawings are illustrative of embodiments of the present invention and are not intended to limit the invention as encompassed by the claims forming part of the application, wherein like items are identified by the same reference designations:

DETAILED DESCRIPTION OF THE INVENTION

Figure 1:
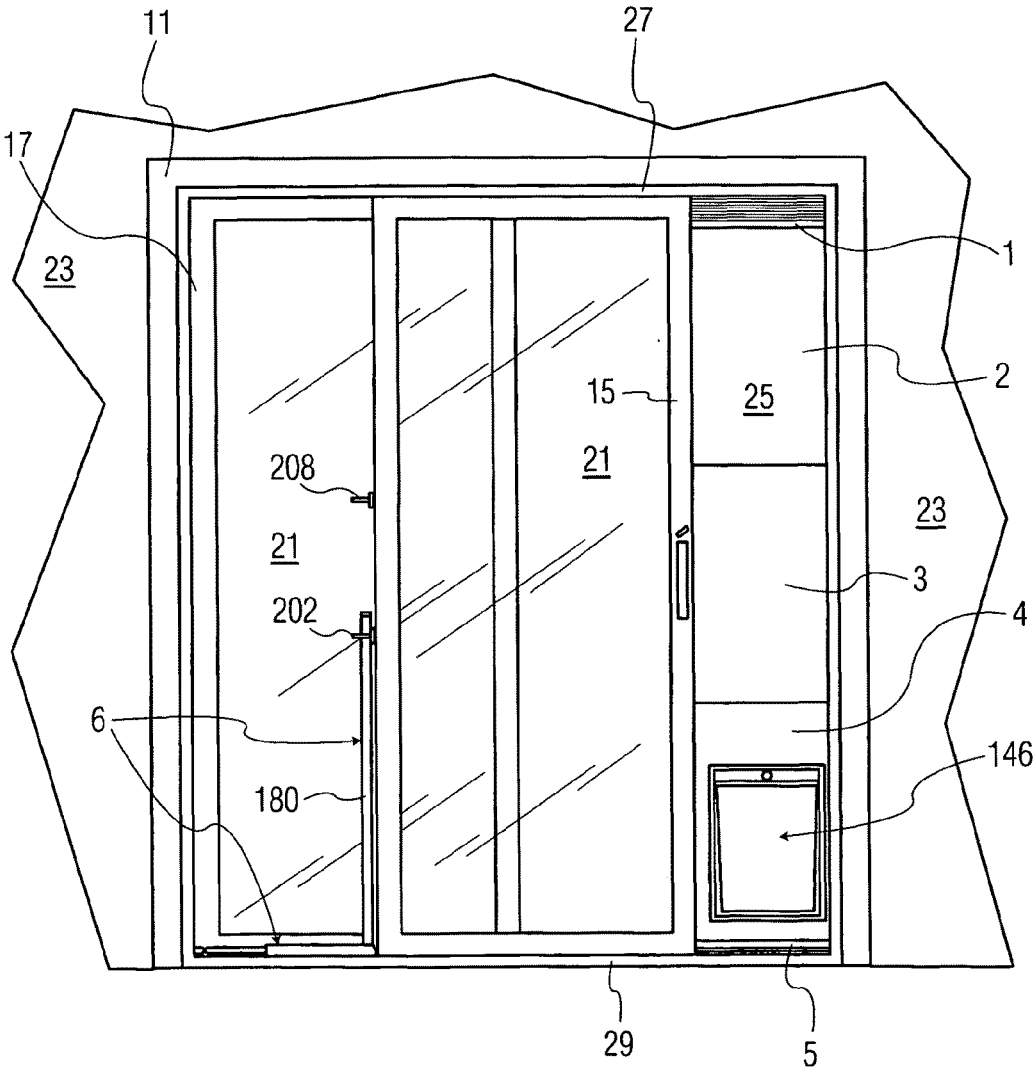
FIG. 1 is a front or interior elevational view of the pet access door installed in a sliding glass patio door with the moveable sliding door in a closed position, providing partial access through the sliding glass door when the moveable sliding door is moved to an open position, for various embodiments of the invention absent a storm window.
Figure 2:
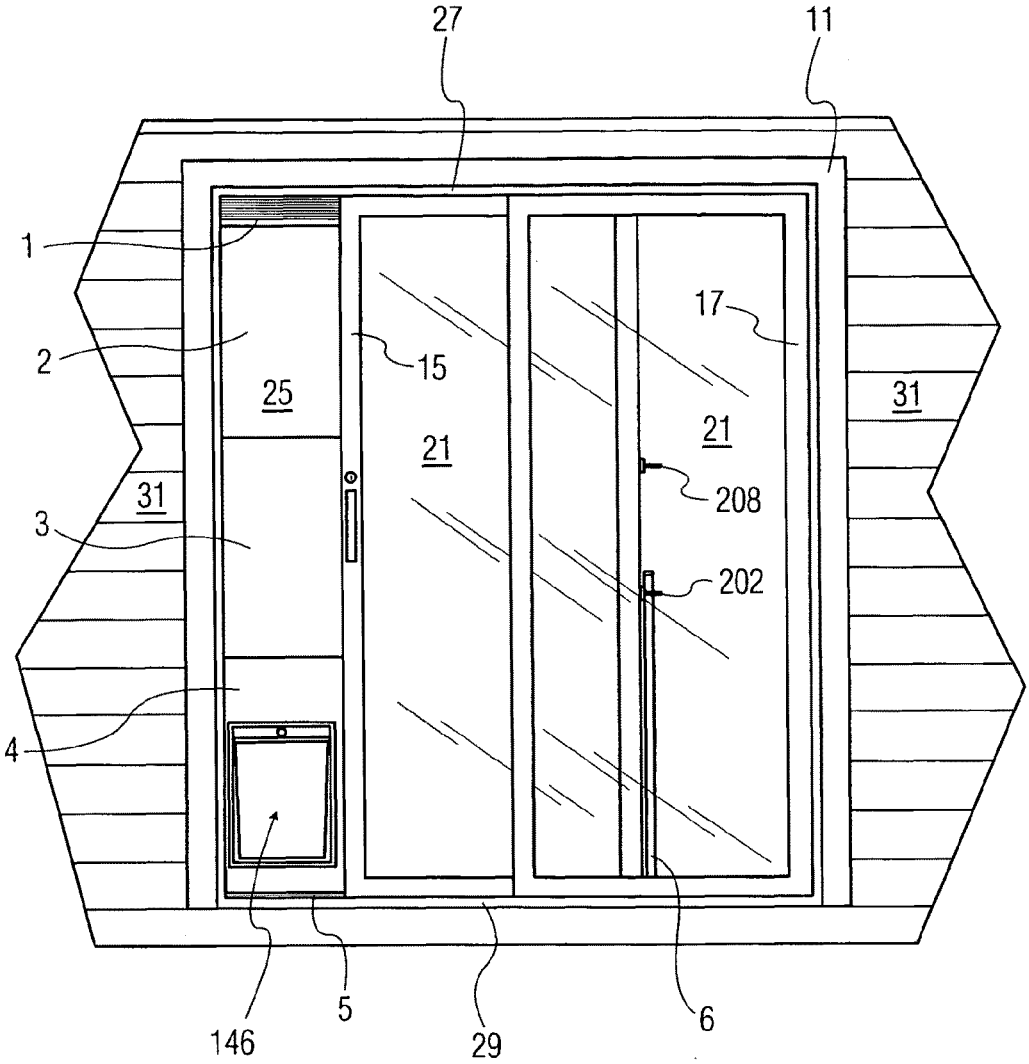
FIG. 2 is a back or exterior elevational view of the pet access door of FIG. 1 installed in a sliding glass patio door with the moveable sliding door in a closed position, providing partial access through the sliding glass door when the moveable sliding door is moved to an open position.

As shown in FIGS. 1-3A to 3F, the preferred embodiment of the invention, pet door panel 25, is installed between the sliding door frame 11, and the leading side of frame 15 on movable sliding door 21, to provide a means of ingress and egress for a pet. Drop lock security lock 6 is installed on the interior side of stationary sliding door 21, between sliding door frame 11, and the trailing side of frame 15 on movable sliding door 21, to secure pet door panel 25 between sliding door frame 11 and the leading side of frame 15 on movable siding door 21, to prevent movable sliding door 21 from being opened with pet door panel 25 installed. Sliding door frame 11 is typically secured to a building structure 23, such as a home or office. For illustrative purposes all elevational views, except as noted, depict the sliding glass patio door in a right opening configuration. Therefore, when describing various elements of the invention reference made to right and left side views pertains to installation of the invention in a right opening sliding glass door configuration. However, since the invention may be installed in either a right or left opening sliding glass patio door configuration the term left or right is relative, therefore, the terms leading, trailing, interior and exterior are used in combination or in place of the terms right and left side and front and back views where referenced.

The sliding door frame 11 has a lower track portion 29 and an upper track portion 27. The lower track portion 29 slideably receives at least one sliding door member 21 therein. A complementary upper track portion 27 is typically positioned on the upper side of the siding glass door frame 11, in alignment with the lower track portion 29, enabling the sliding door member 21 to be slideably moved between open and closed positions within the sliding door frame 11.

Figure 3A:
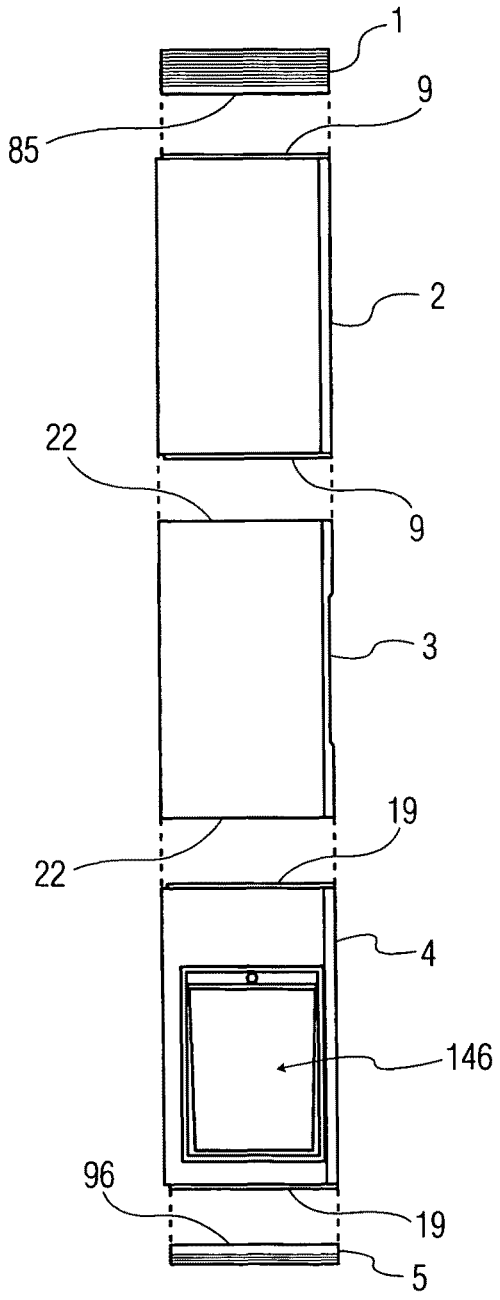
FIGS. 3A-3C show front elevational assembly views of the five primary modules and components comprising the pet access door panel of FIG. 1, and illustrate how the modules and components slide together to assemble the pet access door.
Figure 3B:
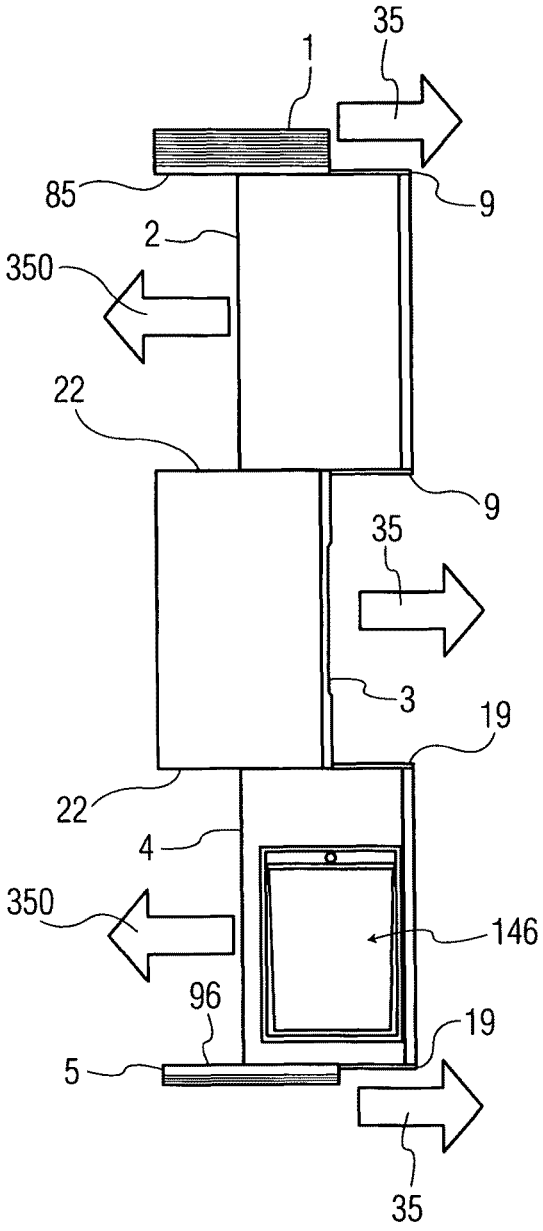

The preferred embodiment of the invention consists of a pet door panel 25 with pet portal 146, drop lock security lock 6 with locking bracket 202, and storage bracket 208. As shown in FIG. 3A, pet door panel 25 is an assembly consisting of five primary components; top module weather seal 1, top module 2, center module 3, bottom module 4 with pet portal 146 and bottom module weather seal 5. In this embodiment, the modules 2 and 3 are shown as being solid, without storm windows or screens, for the preferred embodiment to be described in detail below. Top module weather seal 1, top module 2, center module 3, bottom module 4 with pet portal 146, and bottom module weather seal 5 are slideably attached to one another for assembly, disassembly, or replacement, as shown in FIG. 3B, via an interlocking tongue and groove system integral to each component. More particularly, interlocking groove 85, located in the lowermost portion of top module weather seal 1, is slideably attached to interlocking tongue 9 located on the uppermost portion of top module 2, as indicated by directional arrow(s) 35 and/or 350. Interlocking tongue 9, located on the lowermost portion of top module 2, is slideably attached to interlocking groove 22 located on the uppermost portion of center module 3, as indicated by directional arrows 35 and/or 350. Interlocking groove 22 located in the lowermost portion of center module 3 is slideably attached to interlocking tongue 19 located in the uppermost portion of bottom module 4 as indicated by directional arrows 35 and/or 350. Interlocking tongue 19 located in the lowermost portion of bottom module 4 is slideably attached to interlocking groove 96 located in the uppermost portion of bottom module weather seal 5 as indicated by directional arrows 35 and/or 350.

Figure 3C:
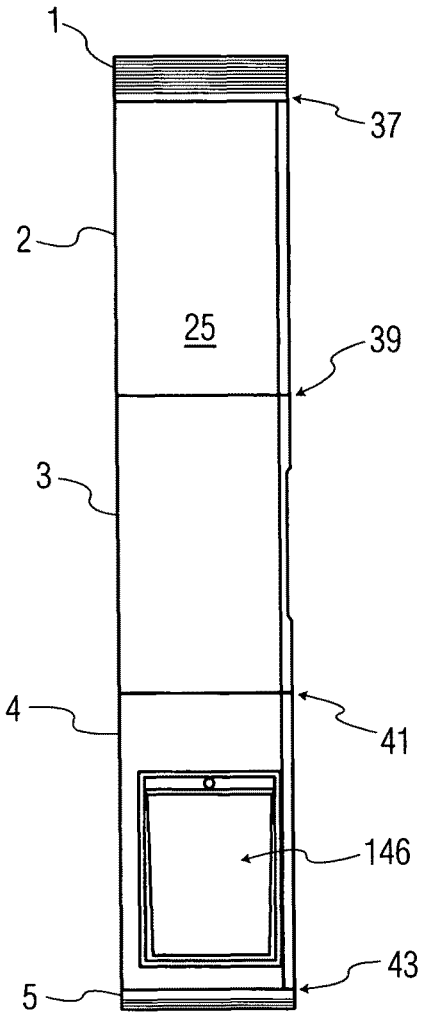

FIG. 3C shows assembled pet door panel 25 with pet portal 146. Top module weather seal 1 is attached to top module 2 at seam 37, top module 2 is attached to center module 3 at seam 39, center module 3 with pet portal 146 is attached to bottom module 4 at seam 41, and bottom module 4 with pet portal 146 is attached to bottom module weather seal 5 at seam 43.

Figure 3D:
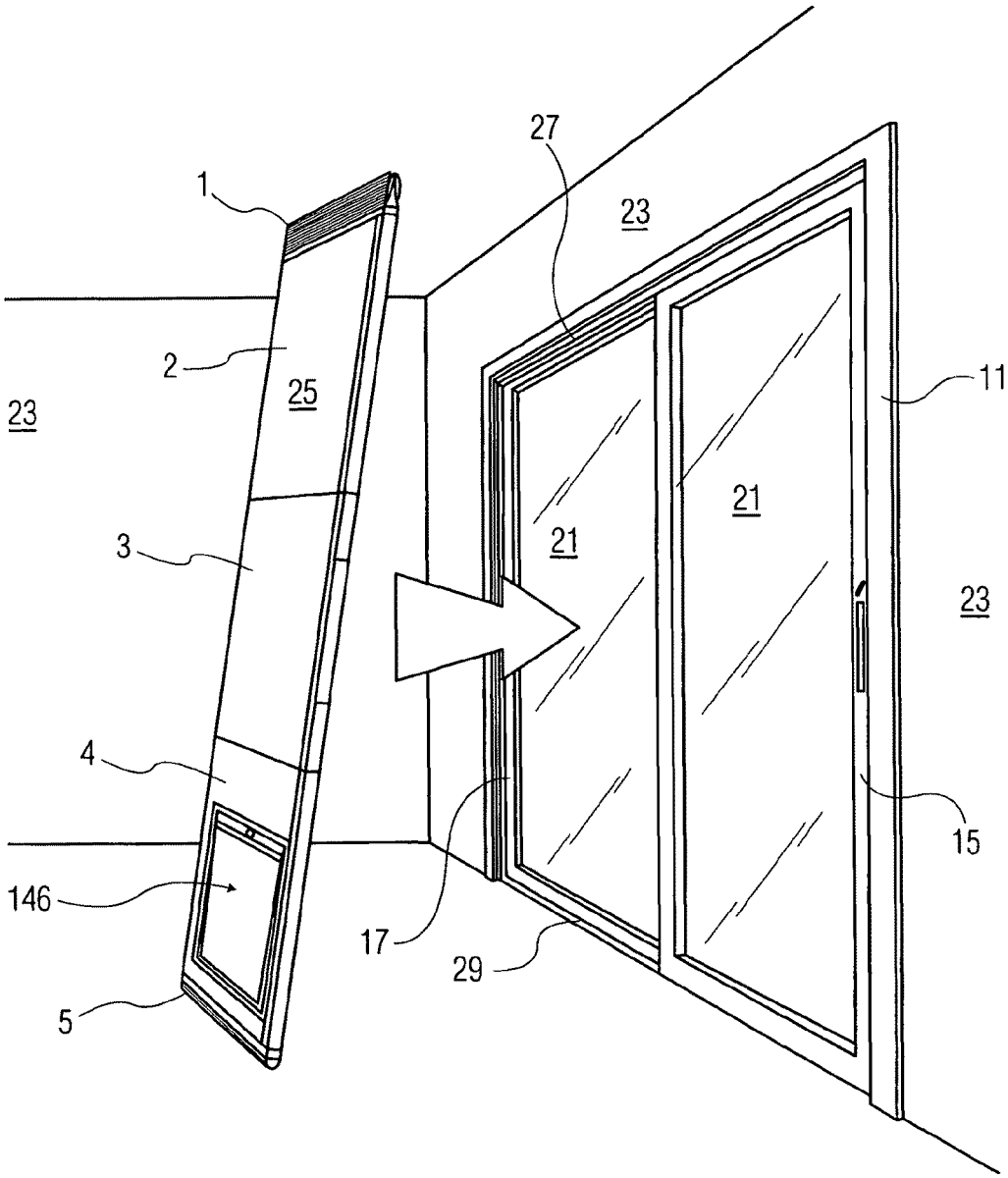
FIG. 3D is a perspective view illustrating the initiation of installation of the pet access door of FIG. 1 into a sliding glass patio door.
Figure 3E:
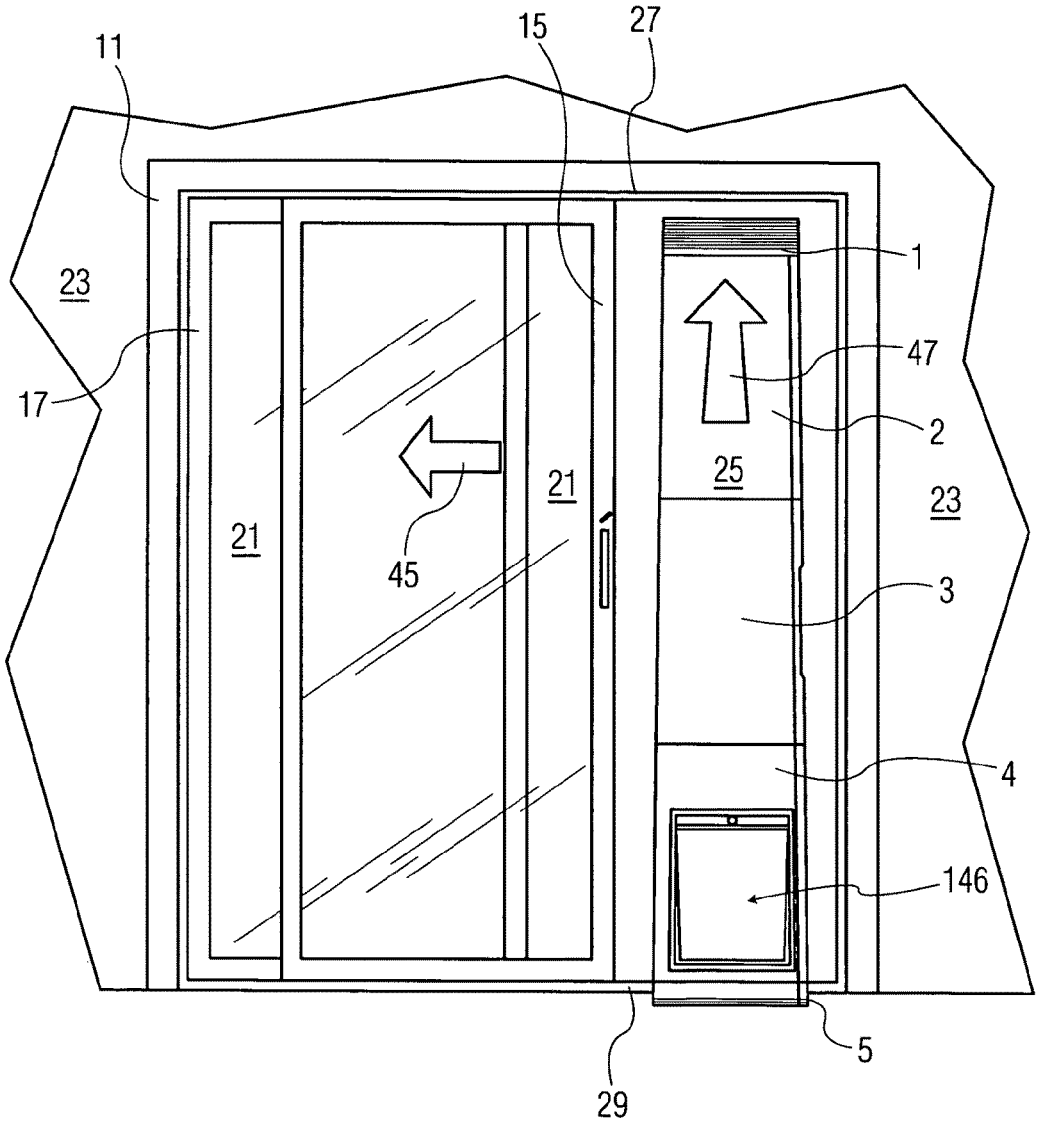
FIG. 3E is a partial perspective and elevational view illustrating a step in the installation of the pet access door of FIG. 1 into a sliding glass patio door.
Figure 3F:
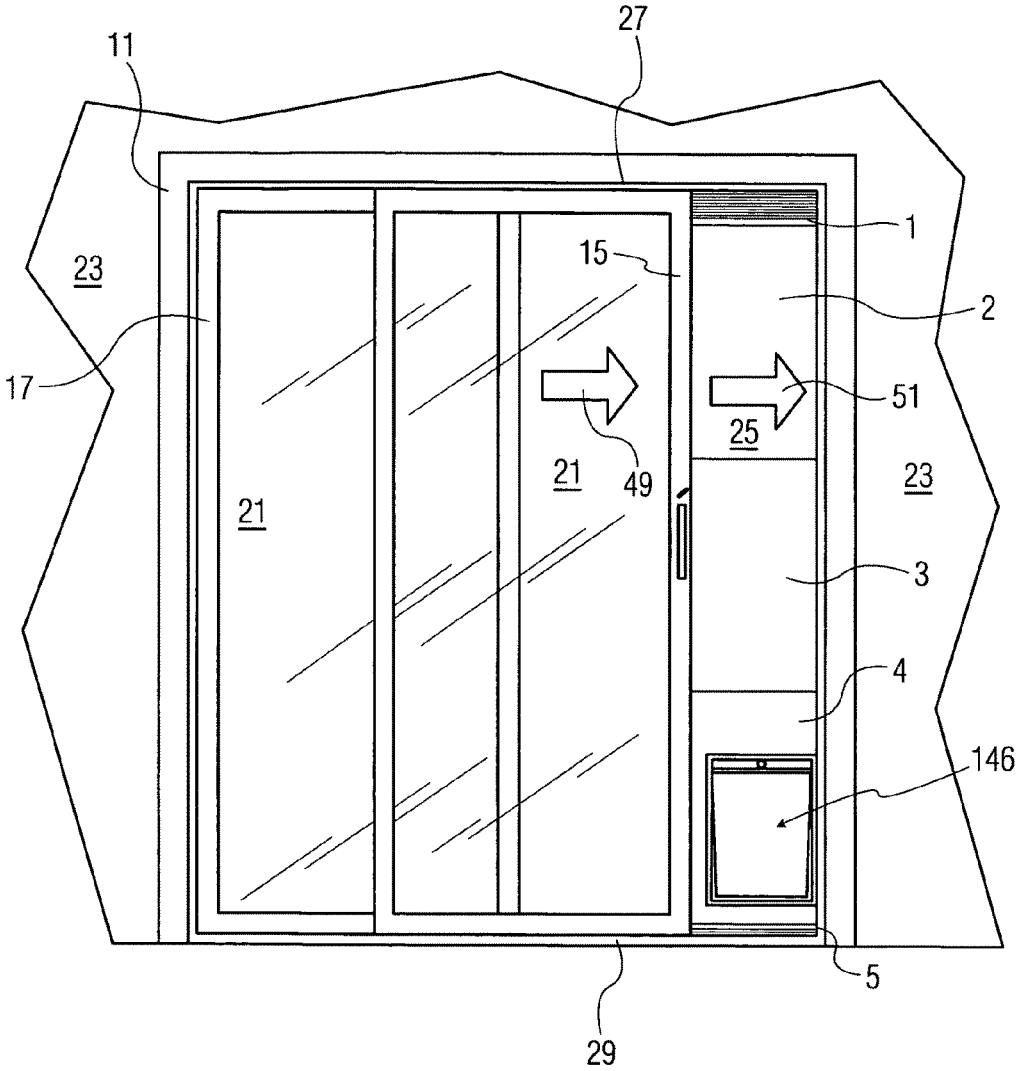
FIG. 3F is an elevational view illustrating a step in the installation of the pet access door of FIG. 1 into a sliding glass patio door.

FIGS. 3D-3F show installation of the assembled pet door panel 25 with pet portal 146 into an existing sliding glass door assembly. Although assembled pet door panel 25 may be assembled in place within sliding door frame 11, the preferred method of assembly is accomplished on a flat surface such as a floor or table top. When assembled outside of sliding door frame 11, the inventive assembled pet door panel 25 is brought to sliding door frame 11 as shown in FIG. 3D. FIG. 3E shows movable sliding glass door 21 being pulled away from sliding door frame 11 to open movable sliding glass door 21 as indicated by directional arrow 45, to permit pet door panel 25 to be installed. The top module weather seal 1 component located on the uppermost portion of assembled pet door panel 25 is lifted up into a recess of upper track portion 27 of sliding door frame 11, as shown in by directional arrow 47, and then rotated into alignment with the upper track portion 27 and a recess of lower track portion 29 of sliding door frame 11. The top module weather seal 1 is constructed to allow a spring loaded flexible sleeve to compress in order to fit pet door panel 25 between upper track portion 27 and lower track portion 29 of sliding door frame 11. When in alignment with upper track portion 27 and lower track portion 29 of sliding door frame 11, the bottom module weather seal 5 component located on the lowermost portion of assembled pet door panel 25 is lowered into the recessed lower track portion 29 of sliding door frame 11. As shown in FIG. 3F, after assembled pet door panel 25 is in place in upper track portion 27 and lower track portion 29 of sliding door frame 11, between the leading side of frame 15 on movable sliding glass door 21 and sliding door frame 11, movable sliding glass door 21 is pulled closed against assembled pet door panel 25 as indicated by directional arrow 49. In turn, assembled pet door panel 25 is pulled against sliding door frame 11 as indicated by directional arrow 51 restricting access through movable sliding glass door 21, while providing egress and ingress for pets through pet portal 146. Frame 15 of movable sliding glass door 21 abuts the trailing side of assembled door panel 25 within a channel formed by trailing side weather seal shims (not shown) in top module 2 and bottom module 4, and weather seal shims (not shown) in center module 3, that comprise assembled pet door panel 25, with assembled pet door panel 25 installed and movable sliding glass door 21 in a closed position. When installed, the leading side of assembled pet door panel 25 abuts sliding door frame 11.

After installation of assembled pet door panel 25 as described above, drop lock security lock 6 is installed between the trailing side of frame 15 on movable sliding glass door 21 by drop lock security lock 6 handlebar 180 and sliding door frame 11, as shown in FIG. 1. Drop lock security lock 6 consists of an adjustable lower housing assembly that sits in lower track portion 29 of sliding door frame 11 between the trailing side of frame 15 on movable sliding door 21 and sliding door frame 11 with assembled pet door panel 25 installed. Drop lock security lock 6 is attached to the trailing side of frame 15 on movable sliding door 21 by handlebar 180, and locking bracket 202 which is mounted on the trailing side of frame 15 of movable sliding door 21. Drop lock security lock 6 can be installed in any sliding glass door between the trailing side of frame 15 on movable sliding glass door 21 and sliding door frame 11, with or without assembled pet door panel 25 installed to prevent forced entry from the exterior or unintentional opening from the interior of the structure.

In another embodiment of the invention, drop lock security lock 6 is the primary means of locking movable sliding glass door 21 with assembled pet door panel 25 installed. In order to open movable sliding glass door 21, the handlebar 180 is rotated out of a locked position in locking bracket 202 and lifted to storage bracket 208 also located on the trailing side of frame 15 on movable sliding glass door 21. In so doing, security lock 6 is lifted out of lower track portion 29 of sliding door frame 11 allowing movable sliding glass door 21 to be pulled opened for passage or installation or removal of assembled pet door panel 25.

Top module 2, center module 3, and bottom module 4 are designed to be of an injection molded or injection blow molded polymer construction with a rigid insulation core. This type of construction provides privacy while providing insulation quality superior to prior art. All three modules are designed to fit a variety of sliding glass patio door heights and door thicknesses through an adjustable top module weather seal 1 and left or trailing side and right or leading side weather seal shims 12 or 13, and 8, respectively.

Figure 4A:
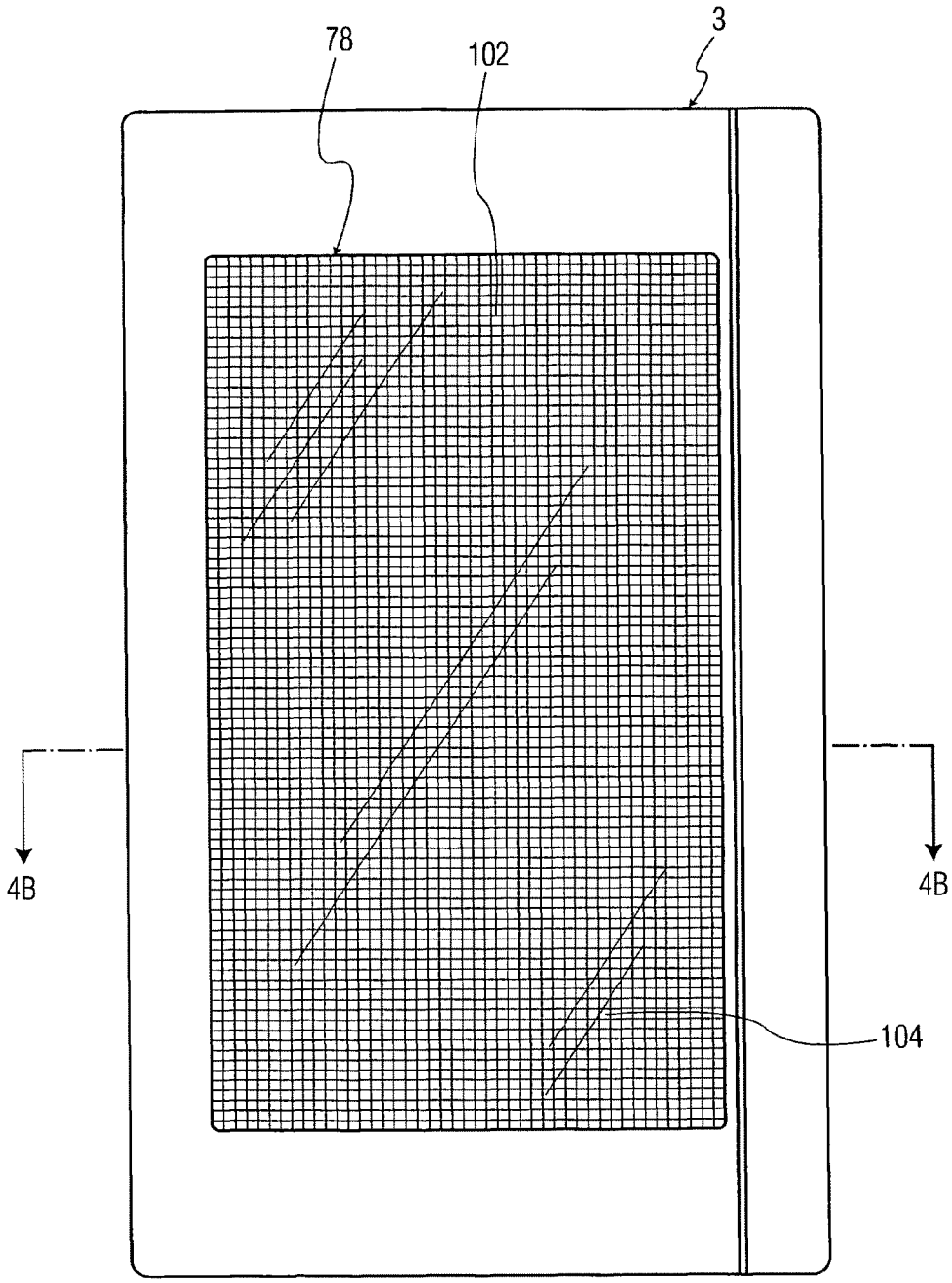
FIG. 4A is a front elevational view of a center module of the pet access door panel of FIG. 1 further including an opening, a ventilation screen, and a storm window in position for one embodiment of the present invention.
Figure 4B:
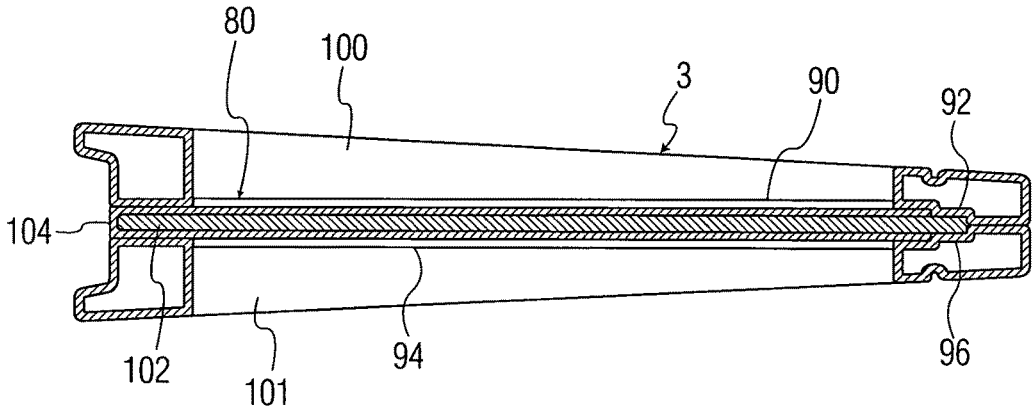
FIG. 4B is a top cross sectional view of the center module taken along 4B-4B of FIG. 4A in accordance with the present invention.
Figure 4C:
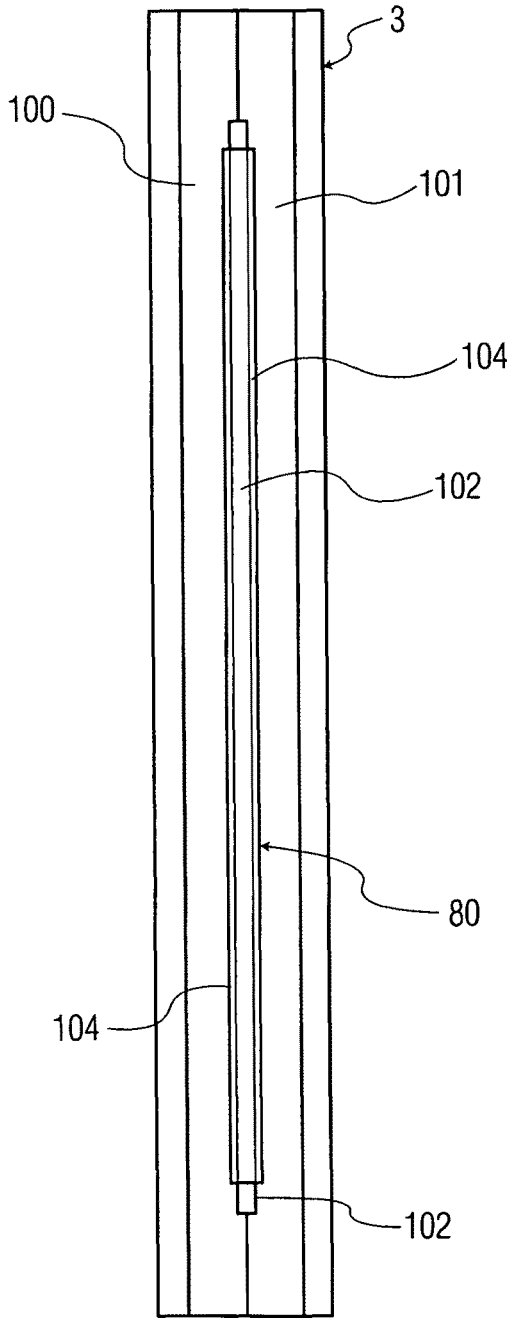
FIG. 4C is a trailing edge view of the center module of FIG. 4A in accordance with the present invention.

FIGS. 4A, 4B and 4C show details of front elevational, top cross sectional trailing edge, and trailing edge views, respectively, of the center module 3 with a window opening 78 having a circumferential channel 80 in which a ventilation screen 102 and storm window 104 are installed. The top module 2 ventilation screen storm window configuration is identical, other than possible dimensional differences, and the use of a top module weather seal 1, as described above.

Figure 5A:
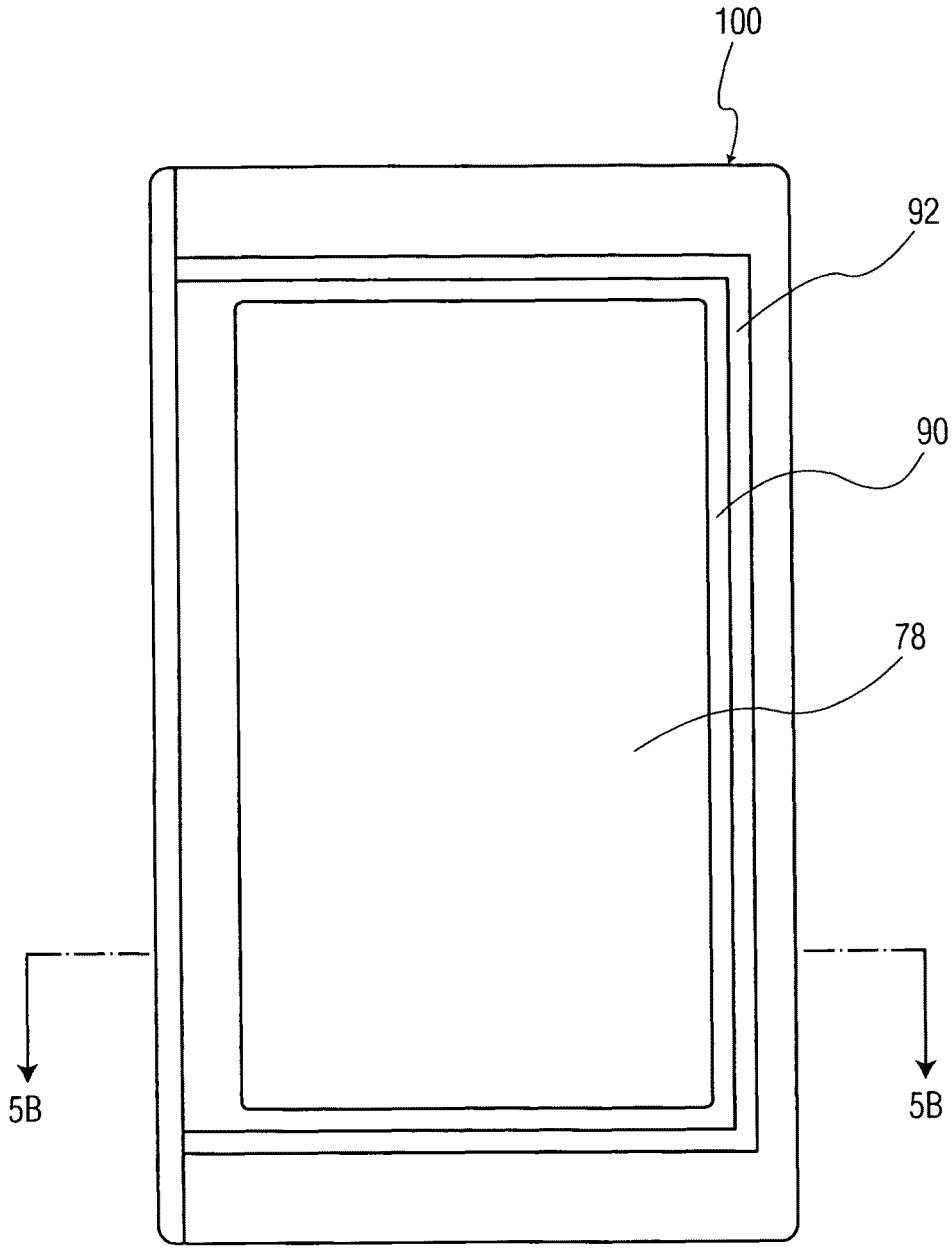
FIG. 5A is an interior side elevational view of a center module half in one embodiment of the present invention.
Figure 5B:
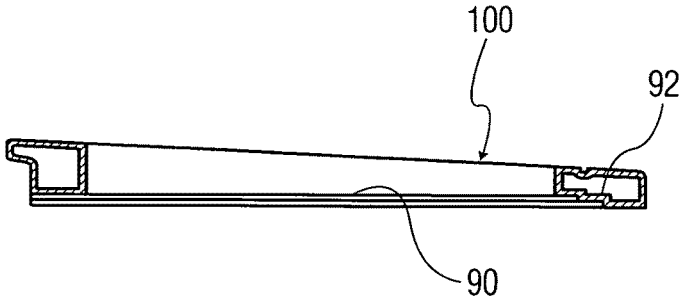
FIG. 5B is a top cross sectional view of the center module half taken along 5B-5B of FIG. 5A in accordance with the present invention.
Figure 5C:
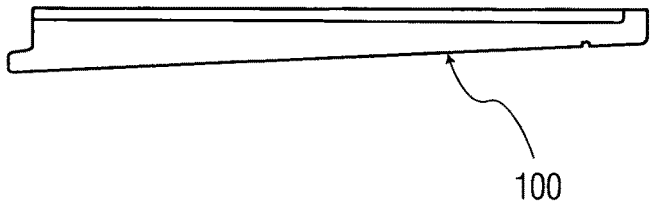
FIG. 5C is a bottom view of the center module half of FIG. 5A in accordance with the present invention.
Figure 6B:
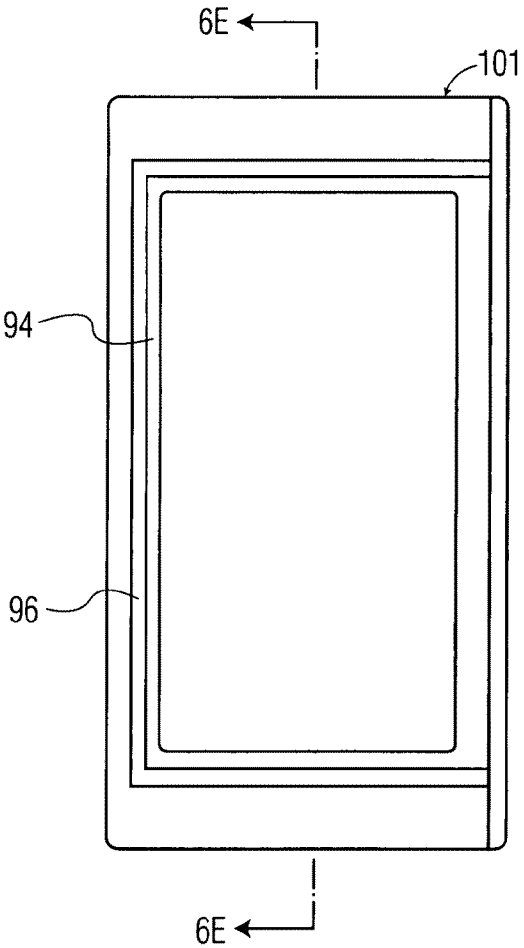
FIG. 6B is an interior side elevational view of a right side center module half in one embodiment of the present invention.
Figure 6A:
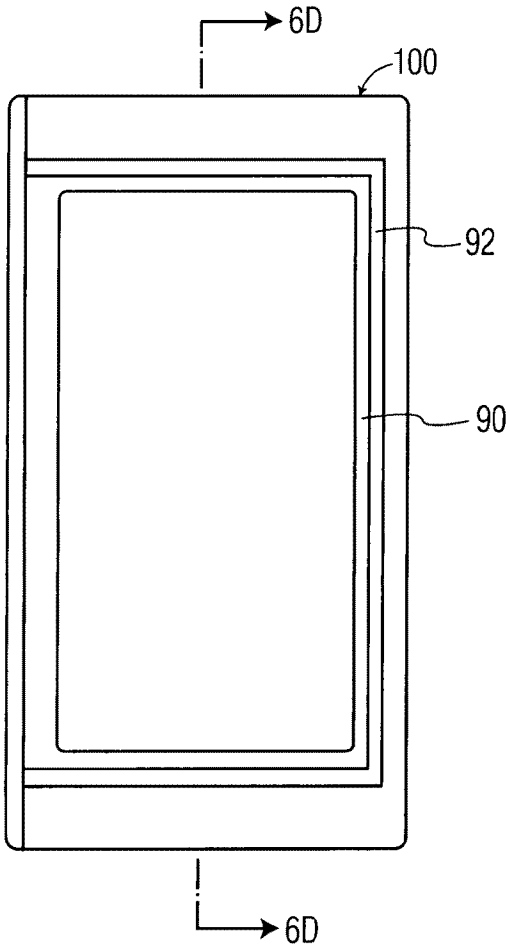
FIG. 6A is an interior side elevational view of a left side center module half in one embodiment of the present invention.
Figure 6E:
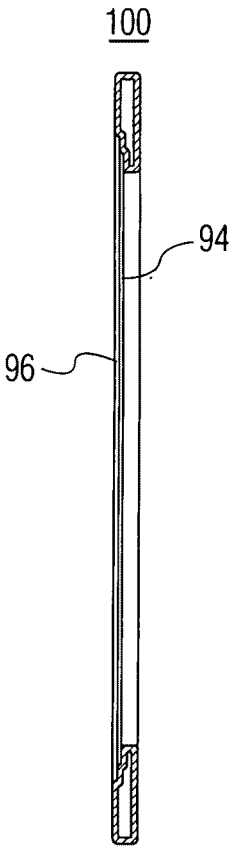
FIG. 6E is a cross sectional view of the right side center module half taken along 6E-6E of FIG. 6B in accordance with the present invention.
Figure 6D:
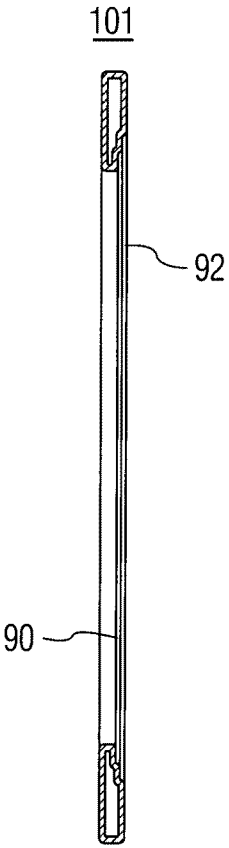
FIG. 6D is a cross sectional view of the left side center half taken along 6D-6D of FIG. 6A in accordance with the present invention.
Figure 6C:
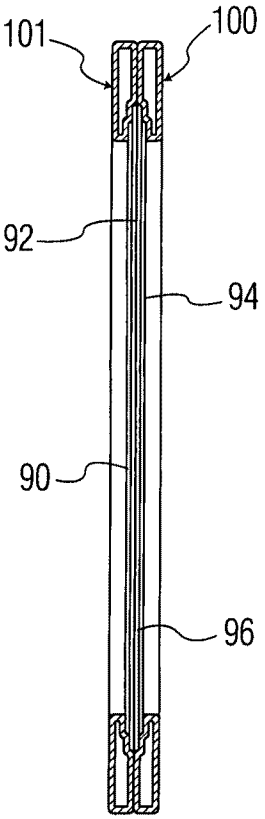
FIG. 6C is a cross sectional view of the right side and left side center module halves of FIGS. 6D and 6E joined along the interior sides to form the center module in accordance with the present invention.
Figure 7B:
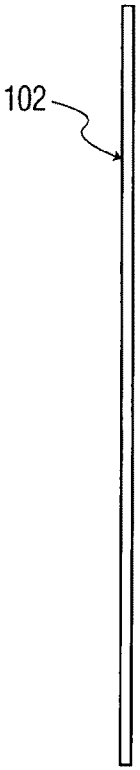
FIG. 7B is a right side elevational view of the ventilation screen of FIG. 7A with the left side elevational view being substantially the same in accordance with the present invention.
Figure 7A:
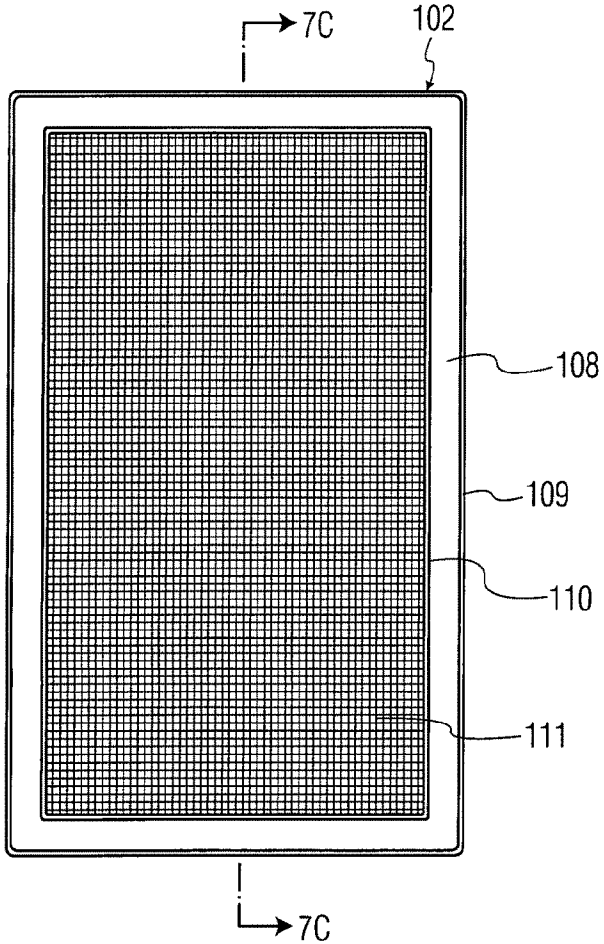
FIG. 7A is a front elevational view of a ventilation screen of the center module for one embodiment of the present invention.
Figure 7C:
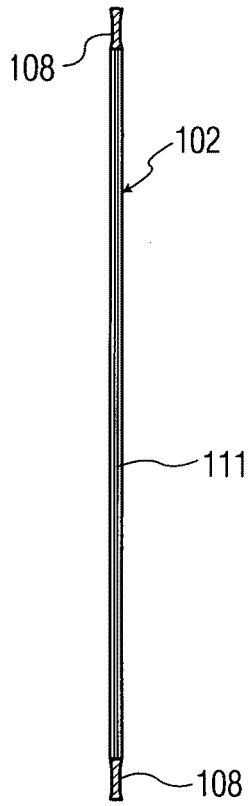
FIG. 7C is a cross sectional view of the ventilation screen along 7C-7C of FIG. 7A in accordance with the present invention.
Figure 7D:
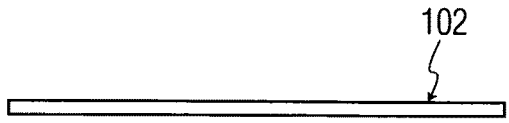
FIG. 7D is a top plan view of the ventilation screen of FIG. 7A with the bottom plan view being substantially the same in accordance with the present invention.
Figure 8B:
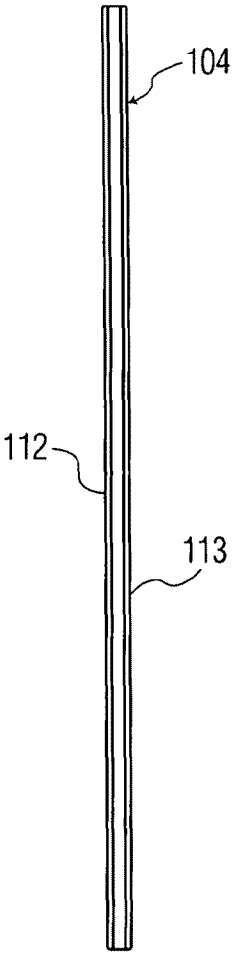
FIG. 8B is a right side elevational view of the storm window of FIG. 8A in accordance with the present invention.
Figure 8A:
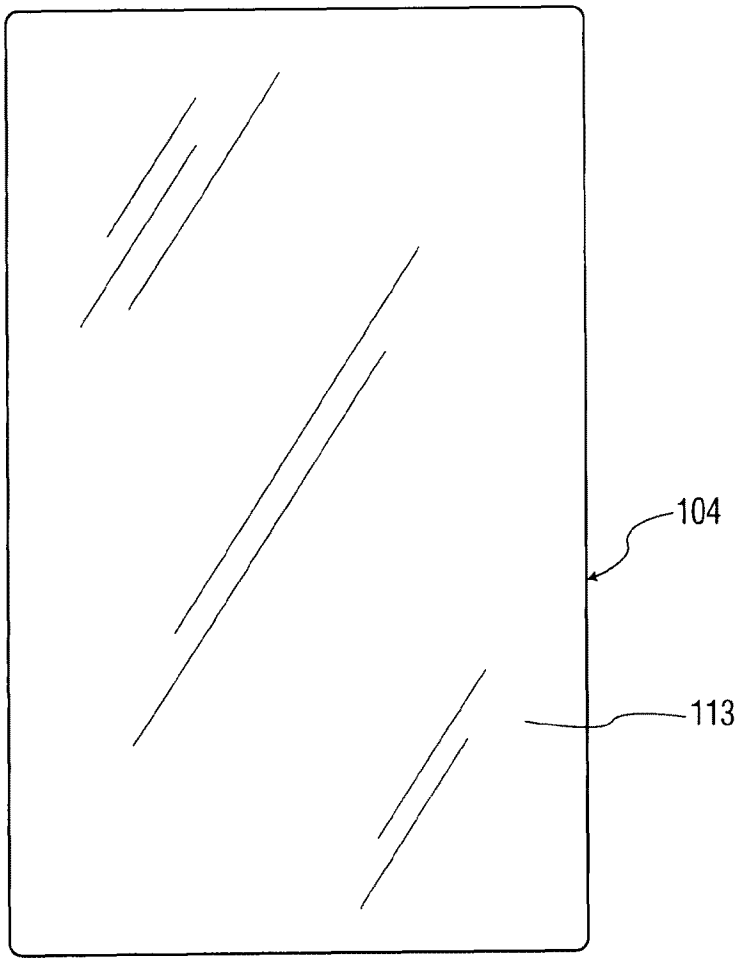
FIG. 8A is a front elevational view of a storm window of the center module for one embodiment of the present invention.
Figure 8C:
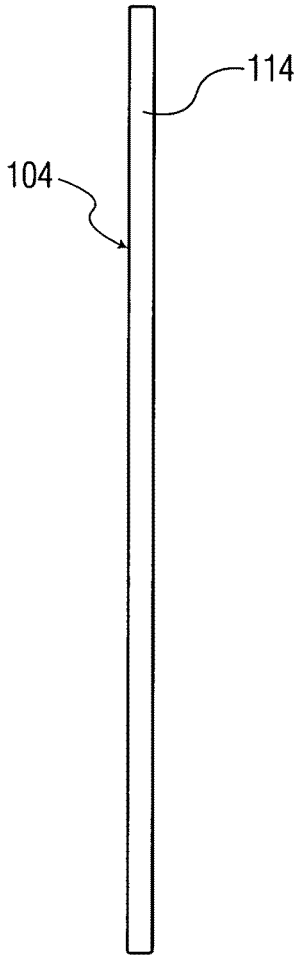
FIG. 8C is a left side elevational view of the storm window of FIG. 8A in accordance with the present invention.
Figure 8D:
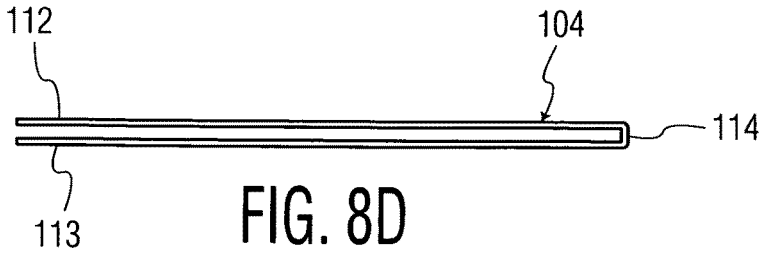
FIG. 8D is a top plan view of the storm window of FIG. 8A, the bottom plan view being substantially the same in accordance with the present invention.

In one embodiment of the invention all three modules 2, 3, and 4 comprising the pet door panel 25 are of a two-piece construction consisting of two halves that are joined together to form a single module. This type of construction permits the formation of recesses 90, 92, 94, and 96 on the interior sides of module halves 100 and 101, respectively, for the top module 2 and center module 3. These recesses 90, 92, 94, and 96 form the ventilation screen 102 and storm window 104 channels within the module 3, when the halves 100 and 101 are joined. FIGS. 5A, 5B, and 5C show a center module half 100 in three views, interior side elevational, top cross sectional, and bottom, respectively, the window opening 78, ventilation screen recess 92, and storm window recess 90. FIGS. 6A, 6B, 6C, 6D, and 6E depict both center module 3 halves 100, 101 each shown in interior views (FIGS. 6A, 6B), respectively, trailing edge cross sectional views (FIGS. 6D, 6E), respectively, and as joined (FIG. 6C) showing ventilation screen and storm window channels or tracks formed by the recesses 92, 96, and 90, 94, respectively, with the halves 100, 101 being joined to complete the module 3, in this example.

The ventilation screen 102 is shown in FIGS. 7A through 7D in front elevational, left side, cross sectional side view taken along 7C-7C, and a top plan view. Note that the screen 102 is encased in a polymer frame 108 with molded in or added soft rubber gaskets 109 on the outside and inside perimeters of the frame that are designed to seal the ventilation screen against the channel within the module formed by the recesses 92, 96 in the joined halves of the module 3, and to seal against the interior of the double pane storm window 104 when inserted over the ventilation screen frame 108. The rubber gasket 109 around the perimeter of the ventilation screen seals against the module halves 100, 101 to prevent air infiltration, while the inside perimeter gasket seals 110 against the inside of the double pane storm window to enhance the insulation quality of the storm window.

Figures 9A, 9B, 9C:
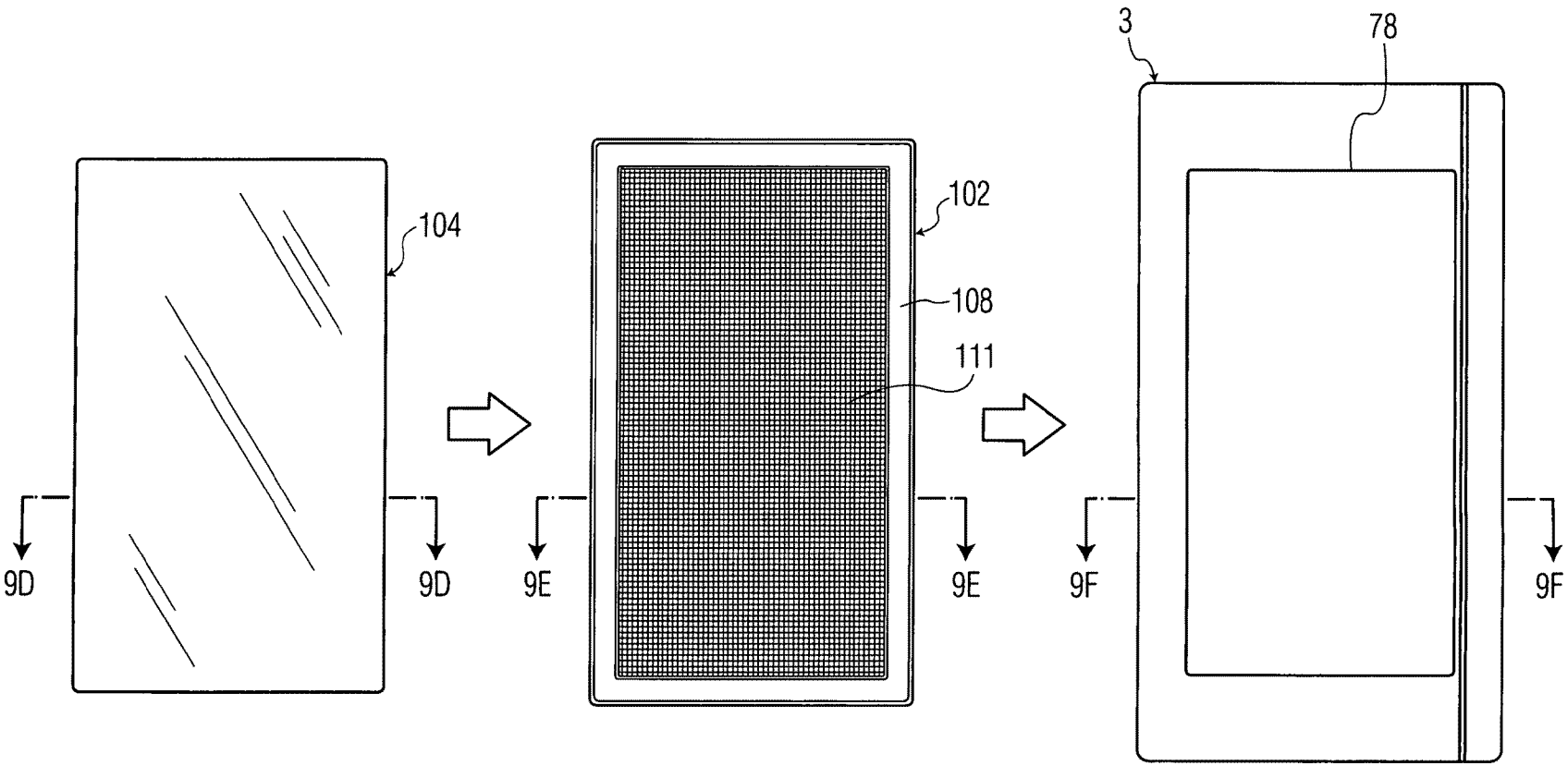
FIGS. 9A, 9B and 9C, in combination, show an exploded assembly view of the center module in one embodiment of the present invention.
Figures 9D, 9E, 9F:
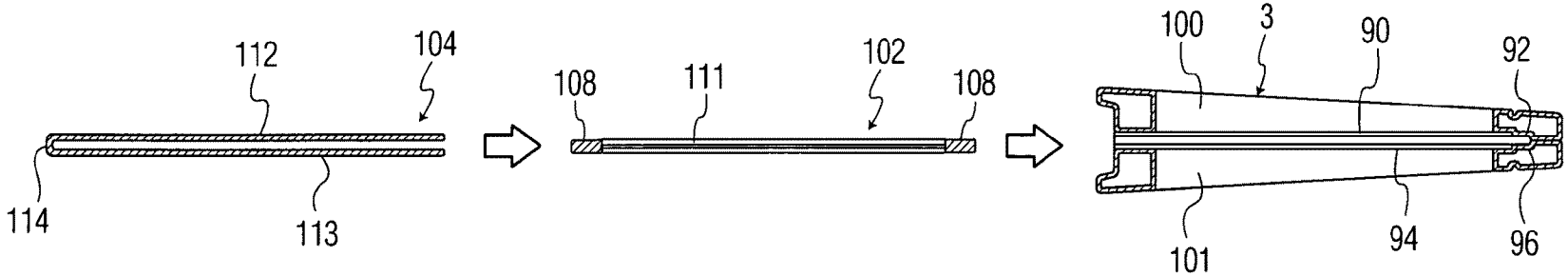
FIG. 9D is a cross sectional view of the storm window taken along 9D-9D of FIG. 9A in accordance with the present invention.
FIG. 9E is a cross sectional view of the ventilation screen taken along 9E-9E of FIG. 9B in accordance with the present invention.
FIG. 9F is a cross sectional view of the joined module halves taken along lines 9F-9F of FIG. 9C in accordance with the present invention.
Figure 10A:
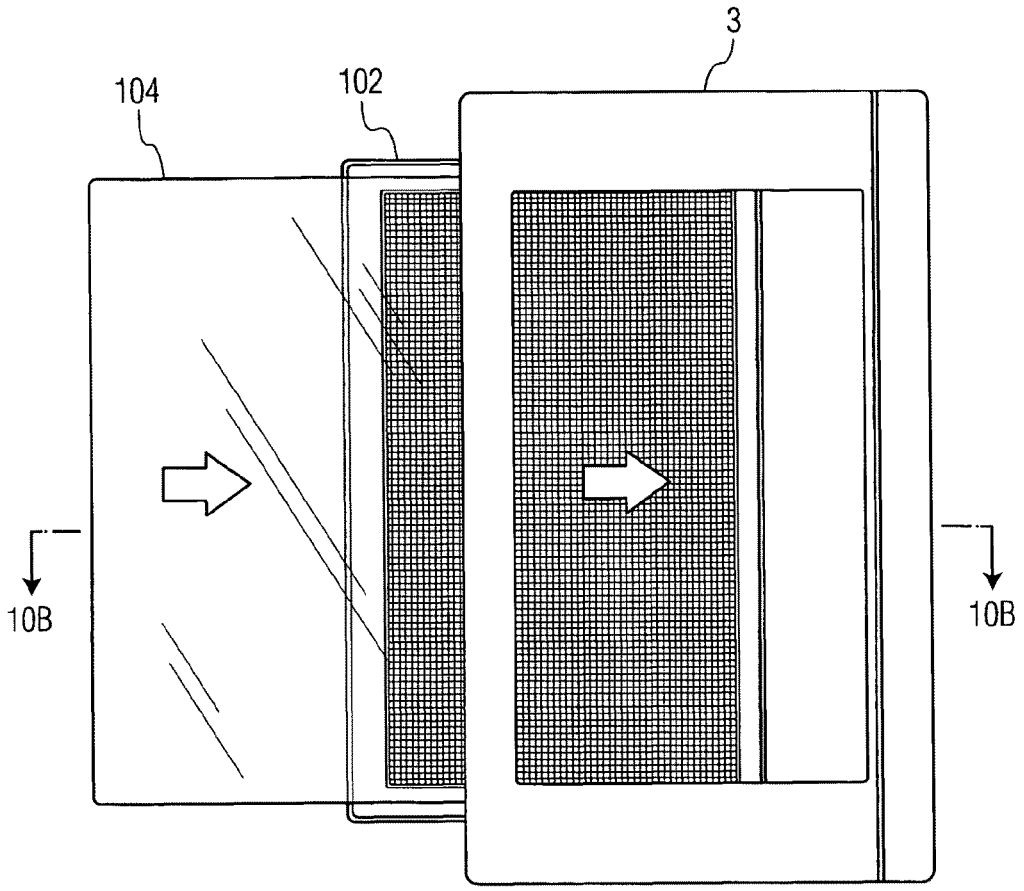
FIG. 10A is a partially assembled view of the center module having the storm window partially inserted over the ventilation screen with the storm window and ventilation screen assembly partially mounted into the module in one embodiment of the present invention.
Figure 10B:
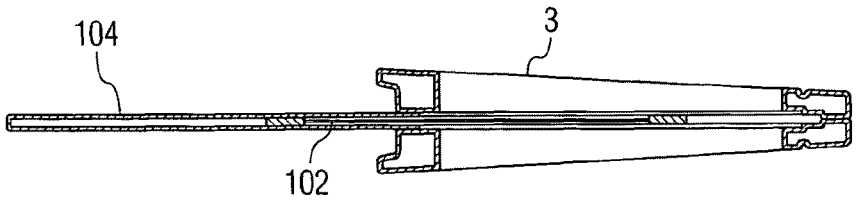
FIG. 10B is a cross sectional view of the center module taken along 10B-10B of FIG. 10A in accordance with the present invention.

In FIGS. 8A through 8D, the storm window 104 is a "U" shaped clear tempered glass or clear polymer panel formed to create two panes 112, 113 with a closed end 114, permitting storm window 104 to be inserted over the ventilation screen 102 and into the storm window channel in the module 3 formed by the recesses 92, 96 with the halves 100, 101 joined. Alternatively, the two panes 112 and 113 can be provided as separate panes for selective installation in either of channels formed by recess 90, and recess 94, respectively. FIGS. 9A through 9C, in combination, show an exploded assembly view of the module 3 components, including storm window 104, and ventilation screen 102. FIGS. 9D through 9F show top cross sectional views of the module 3 components 102, 104 of FIGS. 9A through 9C, respectively. The ventilation screen 102 is inserted into the module 3 by sliding the screen 102 into the channel created by recesses 92, 96 for that purpose in the trailing edge of the module 3. The storm window 104 is then inserted by sliding it over the ventilation screen 102 and inside the channel created by recesses 90, 94 for that purpose in the module. FIGS. 10A and 10B further illustrate the process of inserting the ventilation screen 102 into the module 3, followed by inserting the storm window 104 over the ventilation screen 102 and into the module 3.

Figure 11:
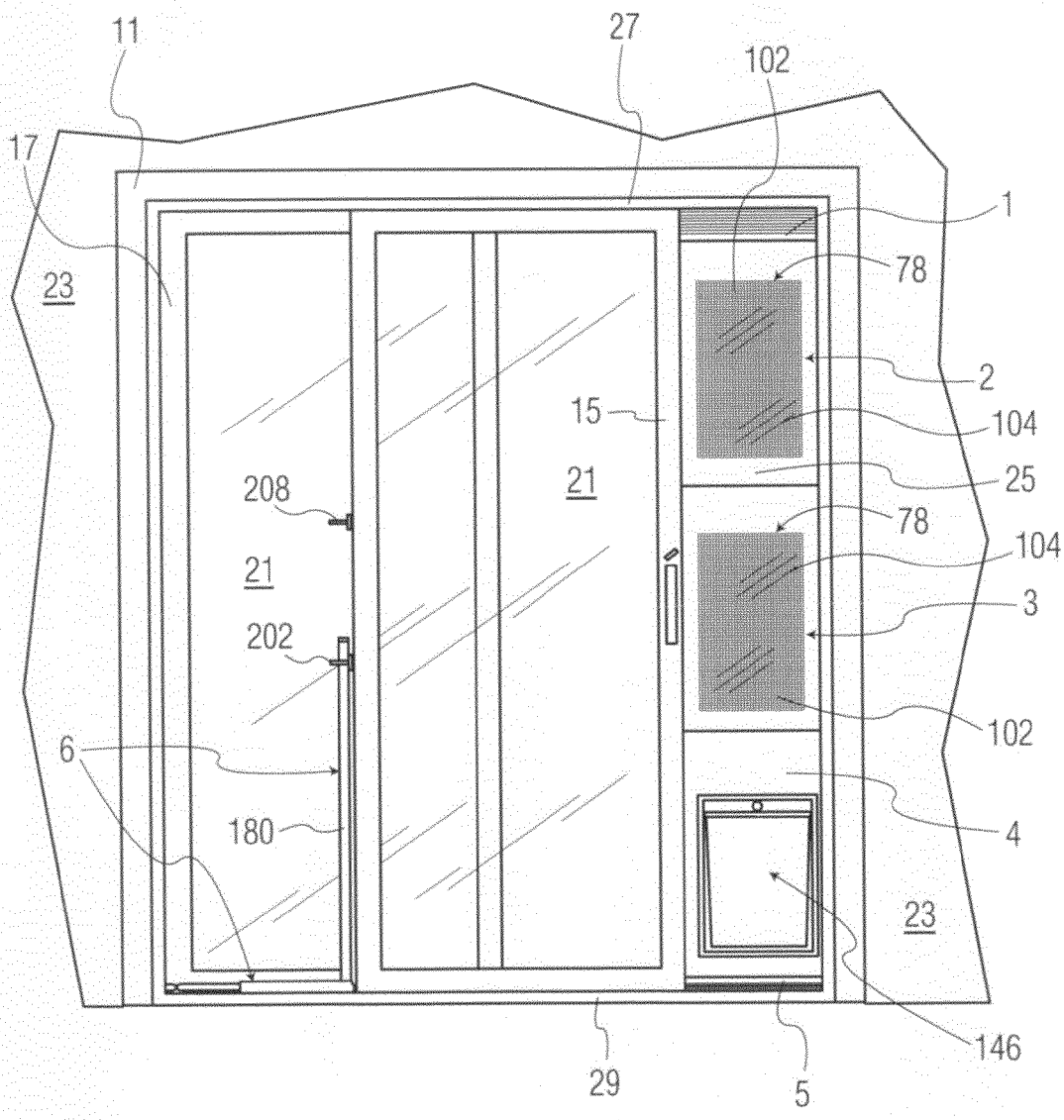
FIG. 11 is a front or interior elevational view of the pet door panel shown in FIG. 1, but with the addition of a storm window and screen in each of the upper two modules.

In inclement or cold weather the double pane storm window 104 when installed, permits light to pass through but prevents outside cold air from infiltrating. When exposure to outside air is desired, the sliding patio door 21 is moved back away from the trailing edge of the pet door panel 25. Next, the storm windows 104 in the top and center modules 2, 3, respectively, of the pet door panel 25 are removed by pulling them back and sliding them out of the associated channels. The sliding patio door 21 is then closed against the trailing edge of the pet door panel 25, and secured to prevent unwanted passage of people, animals, insects, etc. FIG. 11 shows the pet door panel 25 of FIG. 1, but having screens 102 and storm windows 104 installed in each of the top and center modules 2, 3, respectively.

The foregoing discussion discloses and describes merely exemplary embodiments of the present invention. One skilled in the art will readily recognize from such discussion, and from the accompanying claims, that various changes, modifications, and variations can be made therein without departing from the spirit and scope of the invention as defined in the following claims.

What is claimed is:

1. A window module comprising:

a window frame adapted to have a window opening;

said frame having an open side portion, a centrally located first channel extending into said frame from said open side portion, to permit a ventilation screen to be removably slid thereinto to provide airflow through said window opening; and said frame further including extending from said open side portion into said frame, a second channel formed on one side of said first channel, and a third channel formed on an opposing side of said first channel, to selectively permit first and second window panes to be removably slid thereinto, respectively, to prevent air from flowing through the window opening to protect from foul weather and insulate from cold outside temperatures, and said first and second window panes are formed from a monolithic U-shaped panel having a common closed end portion, and an open end portion, whereby the first and second window panes are parallel to one another and spaced apart with each extending from said common closed end portion, having spacing permitting said ventilation screen to be located therebetween, by sliding the first and second window panes via the open end portion through said open side portion onto said first and third channels.

2. The window module of claim 1, wherein the first and second storm window panes each comprise transparent material.

3. The window module of claim 1, further comprising a first end portion configured for seating within a recess of a sliding door frame to form a seal therebetween, and an opposing second end portion configured for receiving a leading portion of a movable sliding door to form a seal therebetween.

4. The window module of claim 1, wherein the frame is formed from a molded polymer construction.

5. The window module of claim 1, where the frame further comprises a rigid insulated core.

6. The window module of claim 1, further comprising a pet portal.

7. The window module of claim 1, further comprising a top weather seal disposed at a top end thereof, said top weather seal adapted for sealing engagement within a recess of an upper track portion of a sliding door frame.

8. The window module of claim 7, further comprising a bottom weather seal disposed at the bottom end thereof, said bottom weather seal adapted for sealing engagement within a recess of a lower track portion of a sliding door frame.

* * * * *